United States Patent [19]

Pollard et al.

[11] Patent Number: 4,685,811

[45] Date of Patent: Aug. 11, 1987

[54] NON-INTRUSIVE MIXING OF FLUID

[75] Inventors: Geoffrey J. Pollard, Buckinghamshire; Roger C. Baker, Hertfordshire, both of England

[73] Assignee: The British Hydromechanics Research Association, Cranfield, England

[21] Appl. No.: 678,561

[22] PCT Filed: Mar. 27, 1984

[86] PCT No.: PCT/GB84/00102

§ 371 Date: Nov. 28, 1984

§ 102(e) Date: Nov. 28, 1984

[87] PCT Pub. No.: WO84/03845

PCT Pub. Date: Oct. 11, 1984

[51] Int. Cl.[4] ..... B01F 5/06

[52] U.S. Cl. ..... 366/275; 366/340

[58] Field of Search ..... 366/349, 255, 256, 257, 366/258, 259, 260, 262, 275, 273, 333, 114, 336, 340; 417/572

[56] References Cited

U.S. PATENT DOCUMENTS

| | | | |
|---|---|---|---|
| 7,421 | 12/1876 | Eichholtz | 366/255 |
| 2,499,203 | 2/1950 | Warren | 366/275 |
| 2,615,692 | 10/1952 | Moller . | |
| 2,962,201 | 11/1960 | Brillis | 366/275 |
| 3,589,685 | 6/1971 | Gradishar | 366/260 |
| 3,855,368 | 12/1974 | Prochazka et al. . | |
| 3,860,114 | 1/1975 | Merckardt . | |
| 3,975,171 | 8/1976 | Burnham | 366/262 |
| 4,000,086 | 12/1976 | Stoev et al. . | |
| 4,147,481 | 4/1979 | Deutsch | 417/572 |

FOREIGN PATENT DOCUMENTS

| | | |
|---|---|---|
| 1902200 | 1/1969 | Fed. Rep. of Germany . |
| 7800124 | 1/1978 | France . |
| 286342 | 2/1953 | Switzerland . |
| 1281651 | 7/1972 | United Kingdom . |

*Primary Examiner*—Robert W. Jenkins

*Attorney, Agent, or Firm*—Irvin A. Lavine

[57] ABSTRACT

A mixing apparatus includes two compartments which are interconnected by conduits of two different types. The conduit or conduits together of the first type present a lower resistance of flow from one compartment to the other than do the conduit or conduits together of the second type. The conduit or conduits together of the second type present a lower resistance to flow from the other compartment to the one compartment than the conduit or conduits of the first type. Fluid is caused to flow between the compartments through the noted conduits. A method includes providing apparatus as above-described and causing fluid to flow between compartments.

15 Claims, 9 Drawing Figures

NON-INTRUSIVE MIXING OF FLUID

FIELD OF THE INVENTION

The invention relates to apparatus and a method for agitating fluids, for example to effect mixing of two or more fluids, without the intrusion of mixing means through the wall of a container enclosing the fluid medium.

BACKGROUND ART

Known apparatus for agitating a fluid medium comprises a container for the liquid medium; and means movable within the container to effect fluid flow. Movement of this means is effected by driving means which may form part of the apparatus. In this apparatus, the means extend between internal and external parts respectively disposed inside and outside the container.

However, there are occasions where it is desirable and/or necessary to intimately mix two or more fluids in a sealed container without any moving parts entering the container enclosing the fluids. Thus, non-intrusive mixing such as this is required where the contents of a sealed container have to be mixed immediately before use. This might arise, for example, when materials that are stored in sealed containers for prolonged periods separate out into their constituent components. Another application would be the mixing of materials that are toxic, explosive or otherwise dangerous when in contact with air. The mixing apparatus would then have to operate in such a way as to avoid any sealing problems inherent in conventional mixing apparatus involving the use of impellers.

DISCLOSURE OF THE INVENTION

It is an object of the present invention to provide a method and apparatus for this non-intrusive mixing as hereinbefore described.

According to the invention, there is provided apparatus for agitating a fluid medium, for example: to effect mixing of two or more fluids, comprising two compartments (6 and 7) for the fluid medium, conduits (8 and 9, 27 and 28) interconnecting the two compartments and means (10) to vary the pressure in one compartment, characterised in that the conduits are of two types, the conduits of the first type together presenting a lower resistance to flow from one compartment to the other than the conduits of the second type together, and the conduits of the second type together presenting a lower resistance to flow from the other compartment to the one compartment than the conduits of the first type together.

The invention also includes a method of agitating a fluid medium contained in two compartments interconnected by conduits of two types, the conduits of the first type together presenting a lower resistance to flow from one compartment to the other than the conduits of the second type together and the conduits of the second type together presenting a lower resistance to flow from the other compartment to the one compartment than the conduits of the first type together, the method comprising shaking at least one of the compartments so as to vary the pressure of fluid therein.

Apparatus embodying the present invention, for mixing tint with base-colour paint, is hereinafter described by way of example, together with its method of operation, with reference to the accompanying drawings.

MODE FOR CARRYING OUT THE INVENTION

Figure 1:
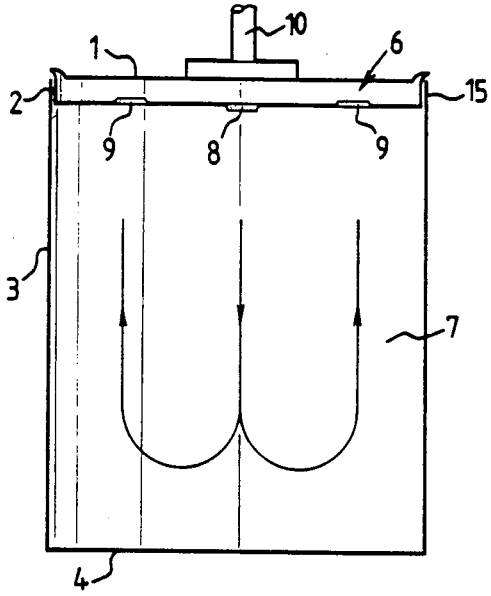
FIG. 1 is a schematic sectional side elevation of apparatus, in accordance with the invention, for mixing tint with base-colour paint showing part of a clamp-on vibrator for use with the apparatus.
Figure 2:
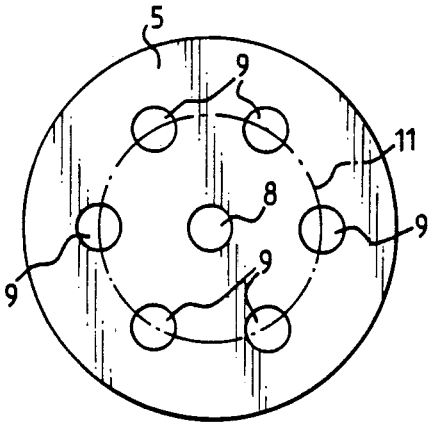
FIG. 2 is a plan view of a partition forming part of the apparatus shown in FIG. 1.

As shown in FIG. 1, a cylindrical paint can 3 having a bottom 4, and rim 15 has a hollow lid including skin 1, edge 2 and a lower skin which constitutes a partition 5 which, when the edge 2 of the lid is inserted into the rim 15 of the can serves to divide the can into first and second compartments 6 and 7. As shown in FIG. 2, the partition 5 is formed with a central first aperture 8 and six equiangularly spaced second apertures 9 disposed on a pitch circle 11 centered on the first aperture 8. These apertures 8 and 9 are bell-mouthed to provide tapering cross-sections so that they present significantly lower resistance to flow in one direction than the other. Thus, the central first aperture 8 is orientated so that its direction of predominant flow is downwards, as drawn, into the second compartment 7, and the second apertures 9 are all orientated so that their direction of predominant flow is upwards, as drawn, into the first compartment 6.

Figure 3:
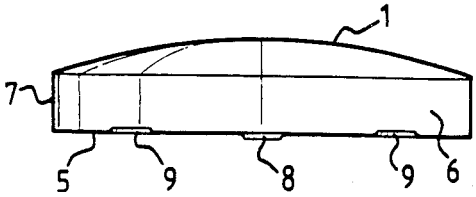
FIGS. 3 and 4 are schematic sectional side elevations of part of the apparatus shown in FIG. 1, illustrating the mode of operation of the apparatus.
Figure 4:
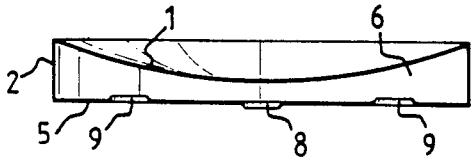

The upper skin 1 of the lid forms a diaphragm which is forced to vibrate by means of a clamp-on vibrator 10 which is attached to the skin or diaphragm 1 by magnetic or mechanical clamping means. As shown in FIGS. 3 and 4, the alternating low and high pressures so generated within the first compartment 6 cause corresponding alternating flow into and out of the first compartment 6. The bellmouthed shape, orientation and position of the first and second apertures 8 and 9 ensure that the flow into the first compartment 6 takes place mainly through the second apertures 9 whilst flow out of the first compartment 6 is mainly through the central first aperture 8 respectively during up and down strokes of the skin or diaphragm 1. As shown in FIG. 3, the low pressure generated during each upstroke of the skin or diaphragm 1 causes inflow, mainly through the ring of outer second apertures 9 which, because of their shape and orientation and because they outnumber the single central first aperture 8, together present the path of least resistance to the flow. During each downstroke, the shape and orientation of the central first aperture 8 and its proximity to the area of maximum displacement of the skin or diaphragm 1 and fluid pressure ensures that it carries most of the outflow created, as illustrated in FIG. 4.

With predominantly downward flow through the central first aperture 8 and upward flow through the outer ring of second apertures 9, a bulk circulation loop is generated within the container. Mixing is promoted by turbulence within both the first and second compartments 6 and 7.

Clearly, it the tint and base-colour paint do not together fill the second compartment 7 and at least part of the first compartment 6, it is necessary to invert the arrangement shown in FIG. 1 and, in practice, this is necessary in all cases where liquid does not occupy the whole of the first and second compartments 6 and 7.

The addition of tint may be carried out in one of two ways. Firstly, it may be added directly to the base-colour paint prior to retail sale or use or, secondly, it could be metered into the first compartment 6 in the lid, e.g. at the paint factory. This second option, which is only possible by virtue of the apparatus according to the invention, offers several advantages over the first option. Thus, retailers do not need to provide floor space for the machinery required to meter tint, they do not need to handle the tint or keep the metering machine filled. Since paint maufacturers require the services of many hundreds of retailers, considerable capital outlay would be saved by avoiding the instalation and maintenance of tinting machines with each retailer. Moreover, paint manufacturers could retain complete control over the amount of tint added, hence limiting colour variations from one can to another. From the end-user's viewpoint, additional cans of paint could be matched provided lids were identified by batch number. This would be more difficult if the tint was added by individual retailers. The second option would also prevent retailers from mixing tints and base-colour paints from different paint manufacturers.

Rather than stock enough cans of each colour to cover fluctuations in demand, it would be necessary for retailers to stock enough cans of base-colour paint to cover fluctuations in total demand together with sufficient stocks of different tints to meet all eventualities.

Where metered amounts of tint were provided in separate can lids, it would be necessary to provide openable sealing means for closing the first and second apertures until mixing of the tint with the base-colour paint.

Figure 5:
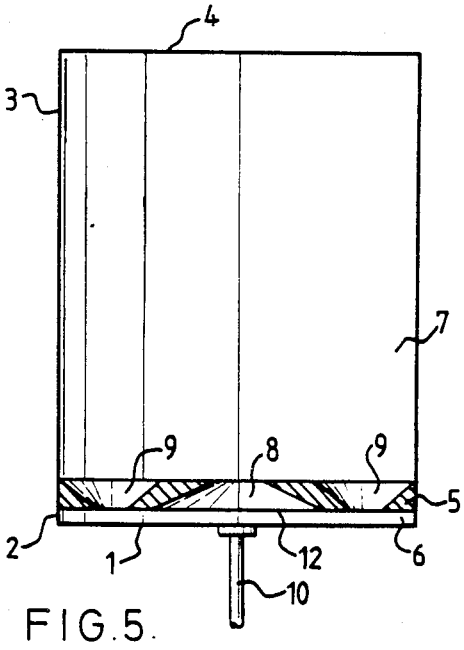
FIG. 5 is a schematic sectional side elevation of a preferred embodiment of apparatus in accordance with the invention.

A preferred embodiment of the invention is illustrated in FIG. 5. In this case, a five litre can having a diameter of 170 mm is provided with a lid enclosing a first compartment 6 having a depth of 3 mm and an enclosed volume of 0.068 liters. The partition 5 has a thickness of 14 mm and is formed with a central first aperture 8 having a smaller diameter of 16 mm and a larger diameter of 80 mm and with six second apertures 9 equiangularly spaced around a 120 mm diameter pitch circle and which each have a smaller diameter of 16 mm and a larger diameter of 50 mm.

As shown, the cone angle of the central first aperture 8 should be larger than the cone angle of each second aperture 9 and, in general, the larger diameter of the central first aperture 8 should be as large as possible, consistent with strength and stability of the partition 5, with an inlet cross-section limited only by the outlet cross-sections of the outer second apertures 9. Moreover, the second apertures should be disposed as far as possible from the central first aperture 8, so as to facilitate fluid flow in opposite directions, and in the embodiment shown the inlet cross-sections of the second apertures 9 extend laterally to the second wall portion (3 and 4).

When the vibrator 10 operates the diaphragm 1 so as to provide a 2 mm peak-to-peak displacement at a frequency in the range of 35 to 55 Hz, this particular arrangement will intimately mix the contents of the can 3 within one minute.

A plastic foil 12 extends across the partition 5 so as to block the first and second apertures 8 and 9 and thereby seal the tint within the first compartment 6. On application of the vibrator 10, the tint within the first compartment 6 ruptures the plastic foil 12 to allow circulation of fluid through the first compartment 6.

Figure 6:
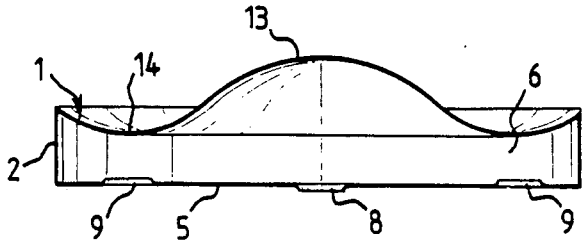
FIGS. 6 and 7 are schematic sectional side elevations of a lid similar to the lid of the apparatus shown in FIG. 1, but illustrating an alternative mode of operation.
Figure 7:
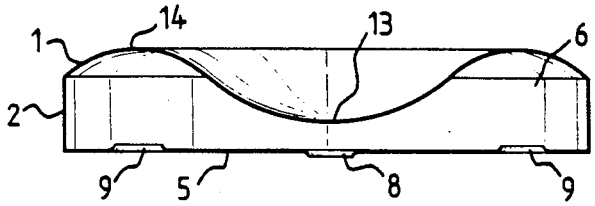

In an alternative method of operation, the vibrator 10 shown in FIG. 1 actuates the diaphragm at the resonant frequency at which the diaphragm flexes in a second mode, as shown in FIGS. 6 and 7, with a central portion 13 of the diaphragm 1 flexing inwardly and outwardly while an outer annular portion 14 simultaneously flexes outwardly and inwardly.

As the central portion 13 of the diaphragm 2 moves inwardly from the position shown in FIG. 6 to the position shown in FIG. 7, there is a rise in pressure in that part of the first compartment 6 below the central diaphragm portion 13 and a decrease in pressure in that part of the first compartment 6 below outer annular diaphragm portion 14. Fluid therefore flows from the first compartment 6 to the second compartment 7 through the central first aperture 8 and flows from the second compartment 7 to the first compartment 6 through the outer second apertures 9, thereby mixing the fluids in these compartments 6 and 7.

However, as the central portion 13 of the diaphragm 2 moves outwardly, back to the position shown in FIG. 6, there is a reduction in pressure in that part of the first compartment below the central diaphragm portion 13 and an increase in pressure in that part of the first compartment 6 below the outer annular diaphragm portion 14 and this causes movement of fluid within the first compartment 6 in such a way as to equalise pressure throughout the first compartment 6 without necessarily involving significant flow of fluid between the first and second compartments 6 and 7.

Figure 8:
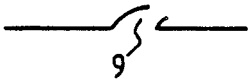
FIG. 8 is a tangential section through a hole of the partition of FIG. 7.

A circumferential component of fluid flow can be introduced by constructing the off-centre holes so as to deflect fluid flowing therethrough tangentially. Thus while the radial cross-section of the holes 9 is symmetrical with respect to the hole axes, as seen in FIG. 7, the tangential cross-section as shown in FIG. 8 is such as to deflect fluid flowing through tangentially towards the next hole 9 in the ring around the central hole 8. When holes of each type (8 and 9) are off-centre, each hole can introduce a tangential component of movement to the fluid, each in the same sense of circulation.

Figure 9:
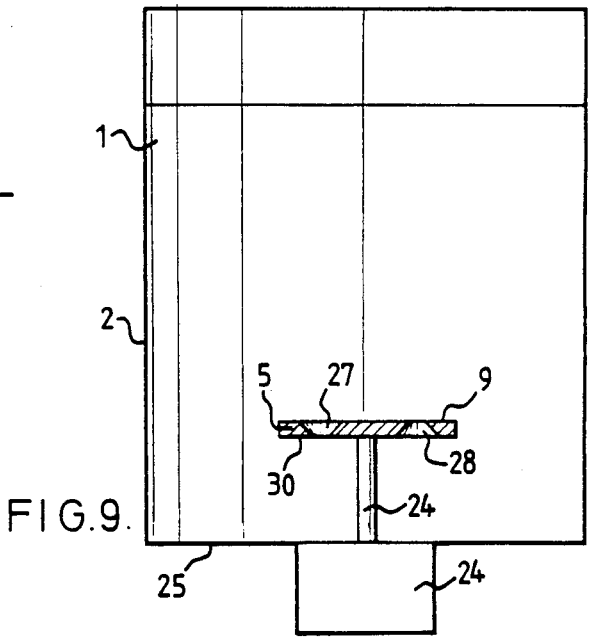
FIG. 9 is a schematic sectional side elevation of an alternative form of apparatus.

Neither the partition nor the diaphragm has to form part of the lid of the can. For example, the partition may be mounted close to the base of the can and the base of the can act as the diaphragm. The partition need not be connected around its periphery to the can. As illustrated in FIG. 9, the partition may be a plate mounted on a stalk 24 from the end wall 25 of the can. The end wall 25 carries a vibrator 26 on its exterior in order to vary the pressure of one side of the partition 5. The plate can be thought of as a partition having an annular aperture (between the can walls and the periphery of the plate) and two types of inner apertures. In this embodiment, these two apertures 27 and 28 converge, respectively, from the first side 29 to the second side 30 of the impeller plate 5 and from the second side 30 to the first side 29 of the impeller plate 5. Each first aperture 27 therefore presents a lower resistance to flow from said one side 29 of the plate 5 to said other side 30 of the plate 5 than to flow from said other side 30 of the plate 5 to the said one side 29 of the plate 5 and each second aperture 28 presents a lower resistance to flow from said other side 30 of the plate 5 to said one side 29 of the plate 5 than to flow from said one side 29 of the plate 5 to said other side 30 of the plate 5. The dimensions of the first and second apertures are the same so that the first aperture 27 presents a lower resistance to flow from said one side 29 of the plate 5 to said other side 30 of the plate 5 than the second aperture 28 and the second aperture 28 presents a lower resistance to flow from said other side 30 of the plate 5 to said one side 29 of the plate 5 than the first aperture 27. With this arrangement, vibration of the plate 5 causes differential pressures on opposite sides of the plate 5 and this results in greater agitation of the liquid medium constituents of the paint 7. When there is more than one aperture of a type (i.e. the type like aperture 27 or the type like aperture 28) it is the combined resistance of the apertures of one type which is significant, not the individual resistances.

When the annular aperture between the can walls and the periphery of the plate 5 is included in consideration, there are three types of aperture with differing resistances to fluid flow therethrough, and it would be possible for one of the holes 27 and 28 to be omitted. As illustrated, the annular aperture has the same resistance to fluid flow in one direction as the other. This is arranged to less than the resistance of the apertures 28 to flow in one direction and greater than the resistance of the apertures 28 to flow in the other direction. The annular aperture can be arranged to have different resistances to flow in the two directions by dishing the rim of the plate 5.

The stalk 24 is rigid, and vibration of the end wall 25 by the vibrator 26 is transmitted to the plate 5 which is thus vibrated through the fluid contents of the can. During one stroke of the plate 5, more fluid will pass through the aperture 27 than through the aperture 28, causing differential pressures across the faces of the plate 5 resulting in movement of the fluid contents across the faces of the plate 5. During the opposite stroke, more fluid will pass through the aperture 28 than through the aperture 27, resulting in fluid flow in the opposite direction across the faces of the plate 5. There will also be motion around the ends of the plate 5, and all these motions cause mixing of the fluid contents in the can.

When the container is completely filled by fluids being mixed, the orientation of the apparatus is of no consequence. When the fluids only partially fill the container, the volume within which pressure is varied on one side of the partition should be below the partition, so that the pressure variation is imparted to the fluids and not to vapour or gases above it.

Although the main purpose of the invention is to provide apparatus for non-intrusively mixing a sealed container, it is apparent that it could also be applied to a container that is open to the environment. The invention is also applicable not only to batch mixing, but also to continuous mixing, in which the containers illustrated in the figures are modified to have an outlet for the mixture of fluids and an inlet or inlets for the fluids to be mixed.

The various embodiments described with reference to the drawings can be modified while remaining within the invention. Although only one partition 5 has been illustrated, more than one may be provided. Placing two or more partitions in series may provide a higher ratio of discharge coefficients in the "forward" and "backward" directions. Similarly, more than one vibrating diaphragm may be provided, for example one at each end.

Mixing may be improved by tilting the container so that gravity acts in a direction other than axially of the container. This may cause the flow to be asymmetric and the container might be spun slowly about its axis while inclined to the vertical to assist mixing, particularly in the region of the container wall. Pressure may be varied on one side of the partition by vibrating the container bodily, instead of flexing one wall relative to the rest of the container. When the partition and all walls of the container are rigid, the variation in pressure is caused by the inertia of the fluid within the container when the container is bodily vibrated. However, by choosing the effective stifness and mass of the partition 5 and the frequency of vibration such that the partition 5 tends to remain fixed in space while the remainder of the container vibrates relative to it, mixing may be improved. Mixing close to the container walls can be improved by setting holes, particularly those as illustrated in FIG. 8, close to the wall of the container.

When the partition is stiff, it may be an advantage to form it in dished shape since that shape has inherent strength. The shape of the dish may be chosen to conform with the shape of the diaphragm (when provided) when inwardly flexed.

FIGS. 4, 6 and 7 show different modes of vibration of the diaphragm and any other convenient modes may be used. It is advantageous for the holes to be aligned with the antinodes of vibration. The diaphragm does not have to be circular, but can be shaped to suit any desired shape of container.

The method of the invention can be carried out by shaking the container or one compartment thereof by hand rather than by means of the vibrator 10 or 26. In the illustrated embodiments, when the container is shaken by hand, the inertia of the fluids will cause a variation of fluid pressure on one side of the container, thus causing differential flow through the apertures and agitation of the fluids.

Although the embodiments described above relate to a single container divided into two compartments by a partition formed with holes to provide communication between the compartments, it would be possible to form the compartments separately (i.e. not in a single container), communiation being provided between the compartments by two conduits which have the same relative resistance to flow as the holes already described, when the pressure variation is achieved by manual shaking, one compartment only need be shaken.

We claim:

1. Apparatus for agitating a fluid medium comprising two compartments for the fluid medium, a diaphragm partly defining one said compartment, conduits interconnecting the two compartments, the conduits being of two types, the conduit or conduits together of the first type presenting a lower resistance to flow from one compartment to the other than the conduit or conduits together of the second type and the conduit or conduits together of the second type presenting a lower resistance to flow from the other compartment to the one compartment than the conduit or conduits together of the first type and means for flexing said diaphragm to vary the pressure in one compartment so as to force fluid to flow between the compartments through said conduits.

2. Apparatus as claimed in claim 1, wherein the or each conduit of the first type presents a lower resistance to flow from one compartment to the other than the resistance from the other compartment to said one compartment, and the or each conduit of the second type presents a lower resistance to flow from said other compartment to said one compartment than the resistance from one compartment to said other compartment.

3. Apparatus as claimed in claim 1, wherein the compartments are divided from each other by a partition, the conduits being holes in the partition.

4. Apparatus as claimed in claim 3, wherein the partition is mounted on the wall of said one compartment independently of said diaphragm.

5. Apparatus as claimed in claim 3, wherein said partition is mounted by a rigid supporting means from said diaphragm so that the motions of the partition and the diaphragm are substantially the same.

6. Apparatus as claimed in claim 3, comprising a single hole of the first type, and a plurality of holes of the second type spaced around a pitch circle centered on said hole of the first type.

7. Apparatus as claimed in claim 3, wherein a said hole is shaped to deflect fluid flowing therethrough to have a component of flow parallel to said partition.

8. Apparatus as claimed in claim 7, wherein a plurality of said holes are provided in a ring around the partition, each hole being shaped to deflect fluid flowing therethrough towards the next adjacent hole.

9. Apparatus as claimed in claim 3, wherein the two compartments are formed in an elongated body and the partition extends transversely to the direction of elongation.

10. Apparatus as claimed in claim 3, wherein the partition conforms to the shape of the diaphragm when the diaphragm is inwardly flexed.

11. Apparatus as claimed in claim 3, wherein the partition extends parallel to the diaphragm when the diaphragm is at rest.

12. Apparatus as claimed in claim 1, comprising openable sealing means for closing said conduits so as to keep the fluids in either compartment separate until mixing is required.

13. Apparatus as claimed in claim 12, wherein the compartments are divided by a partition, the conduits being holes in the partition, the sealing means comprising a foil which extends across the partition and is capable of being ruptured on variation of the pressure.

14. Apparatus as claimed in claim 1, wherein said means comprises a vibrator engaging said diaphragm.

15. A method of agitating fluid comprising:

(a) providing first and second compartments, one said compartment being defined in part by a diaphragm, (b) providing first conduits having a relatively low resistance to flow in one direction and a relatively high resistance to flow in the other direction, and second conduits having a relatively high resistance to flow in said one direction and relatively low resistance to flow in said other direction, (c) interconnecting said compartments with said conduits so that some conduits together provide a lower resistance to flow from one compartment to the other compartment than the other conduits together, and the other conduits together present a lower resistance to flow from the other compartment to the one compartment than the first said conduits together, (d) substantially filling said compartments and conduits with fluid, and (e) causing alternating flow through said conduits by actuation of said diaphragm.

* * * * *